US009845615B2

(12) United States Patent
Ichikawa et al.

(10) Patent No.: US 9,845,615 B2
(45) Date of Patent: Dec. 19, 2017

(54) MOUNTING STRUCTURE OF DECORATIVE CAP

(71) Applicant: ALPHA CORPORATION, Yokohama-shi, Kanazawa-ku (JP)

(72) Inventors: Shinji Ichikawa, Yokohama (JP); Tsutomu Kawanishi, Yokohama (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 0 days.

(21) Appl. No.: 15/347,955

(22) Filed: Nov. 10, 2016

(65) Prior Publication Data

US 2017/0058563 A1 Mar. 2, 2017

Related U.S. Application Data

(63) Continuation of application No. PCT/JP2015/063817, filed on May 13, 2015.

(30) Foreign Application Priority Data

May 13, 2014 (JP) ..... 2014-099324

(51) Int. Cl.
*E05B 17/14* (2006.01)
*E05B 77/34* (2014.01)
(Continued)

(52) U.S. Cl.
CPC ..... *E05B 17/142* (2013.01); *E05B 17/18* (2013.01); *E05B 77/34* (2013.01); *E05B 85/06* (2013.01);
(Continued)

(58) Field of Classification Search
CPC ..... Y10T 70/7955; Y10T 70/796; Y10T 70/7977; Y10T 70/7983; Y10T 70/8649; E05B 17/142; E05B 17/18; E05B 17/14; E05B 17/188; E05B 77/34; E05B 85/06; E05B 85/16
(Continued)

(56) References Cited

U.S. PATENT DOCUMENTS 2,070,955 A * 2/1937 Parisoe ..... E05B 77/34 16/DIG. 12
2,585,331 A * 2/1952 King ..... E05B 77/34 70/455
(Continued)

FOREIGN PATENT DOCUMENTS

JP H05-54772 U 7/1993
JP 2002-295062 A 10/2002
(Continued)

*Primary Examiner* — Lloyd Gall
(74) *Attorney, Agent, or Firm* — Drinker Biddle & Reath LLP

(57) ABSTRACT

A mounting structure of a decorative cap includes a door panel, a cylinder lock fixed to the door panel, and a decorative cap member. A protrusion portion of a cylinder lock protruding 5 from the door panel is covered with the decorative cap member. The decorative cap member includes a water guide channel guiding infiltrated water from a gap between a key insertion opening and a surface of the cylinder lock, to a water ejection opening which is opened on a peripheral wall. The key insertion opening 10 exposes a key insertion section of the cylinder lock.

10 Claims, 4 Drawing Sheets

(51) Int. Cl.
*E05B 85/06* (2014.01)
*E05B 85/16* (2014.01)
*E05B 17/18* (2006.01)

(52) U.S. Cl.
CPC ..... *E05B 85/16* (2013.01); *Y10T 70/796* (2015.04); *Y10T 70/7983* (2015.04); *Y10T 70/8649* (2015.04)

(58) Field of Classification Search
USPC ..... 70/50, 54–56, 208, 210, 381, 423–428, 70/452, 455, DIG. 43, DIG. 56
See application file for complete search history.

(56) References Cited

U.S. PATENT DOCUMENTS 2,658,376 A * 11/1953 Shank ..... E05B 77/34 49/460
3,625,035 A * 12/1971 Brummer ..... H01H 9/04 70/365
4,006,616 A * 2/1977 Rubner ..... E05B 17/181 70/455
4,317,344 A * 3/1982 Barnard ..... E05B 17/002 70/55
4,349,722 A * 9/1982 Kurth ..... E05B 77/34 219/201
4,671,090 A * 6/1987 Masaki ..... E05B 17/181 70/423
4,709,567 A * 12/1987 Appelbaum ..... E05B 17/183 70/455
4,790,163 A * 12/1988 Appelbaum ..... E05B 17/188 70/455
4,858,454 A * 8/1989 McAnulty, III ..... E05B 17/183 16/320
5,241,846 A * 9/1993 Hoke ..... E05B 17/183 70/423
5,303,568 A * 4/1994 Wightman ..... E05B 67/38 70/455
5,758,529 A * 6/1998 Chhatwal ..... E05B 15/02 70/160
6,698,262 B2 * 3/2004 Wittwer ..... E05B 85/107 292/336.3
7,581,423 B2 * 9/2009 Brojanac ..... E05B 17/002 70/423
7,735,347 B2 * 6/2010 Tsuchikiri ..... B60R 25/04 70/423
2005/0275226 A1 12/2005 Watanabe et al.

FOREIGN PATENT DOCUMENTS

JP 2003-155848 A 5/2003
JP 2005-344303 A 12/2005

* cited by examiner

MOUNTING STRUCTURE OF DECORATIVE CAP

CROSS REFERENCE TO RELATED APPLICATIONS

This application is a continuation of PCT application No. PCT/JP2015/063817, which was filed on May 13, 2015 based on Japanese Patent Application (No. 2014-099324) filed on May 13, 2014, the contents of which are incorporated herein by reference.

BACKGROUND OF THE INVENTION

<Field of the Invention>

The present invention relates to a mounting structure of a decorative cap.

<Description of Related Art>

Patent Literature 1 (:JP-A-2003-155848) discloses a mounting structure of a decorative cap that covers a cylinder lock, which controls an opening and closing operation of a door, using a decorative cap member. In the mounting structure of a decorative cap of Patent Literature 1, a protrusion portion from a door panel of the cylinder lock, which is retained in a door of a vehicle, is covered using a block (a decorative cap member). A locking and unlocking operation of the cylinder lock is performed by inserting an unlocking key from an opening that is provided in an open manner in the decorative cap member.

In the mounting structure of a decorative cap of Patent Literature 1, the infiltration of water, which is stagnant inside recessed portions of the opening and the outer surface of the cylinder lock, inside the cylinder lock, or the infiltration of water inside the cylinder lock from a water removal opening, which is provided in the cylinder lock in order to eject water inside the cylinder lock that infiltrates from a boundary between the decorative cap member and the cylinder lock may be causes of an inoperable status of the cylinder lock due to freezing during cold seasons.

[Patent Literature 1] JP-A-2003-155848

SUMMARY

The present disclosure relates to a mounting structure of a decorative cap that can effectively prevent the infiltration of water inside a cylinder lock.

DESCRIPTION OF EMBODIMENTS

Hereinafter, embodiments will be described while referring to the appended drawings. Additionally, the appended drawings and the following disclosure are illustrative examples of the present disclosure, and are not intended to limit the principal subject that is disclosed in the claims.

Figure 1A:
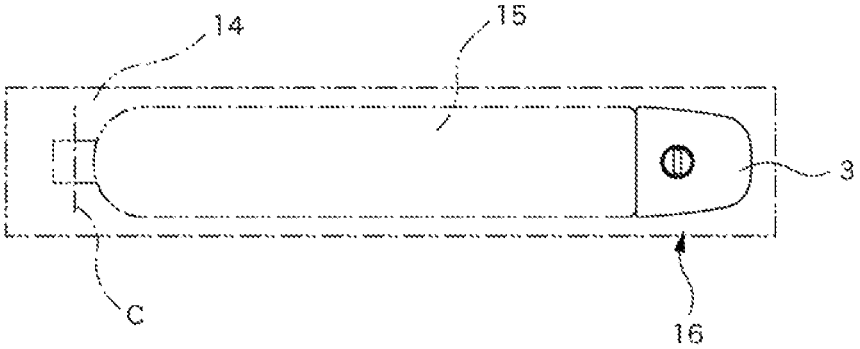
FIG. 1A is a front view of an outside handle device of a vehicle to which a mounting structure of a decorative cap is applied.
Figure 1B:
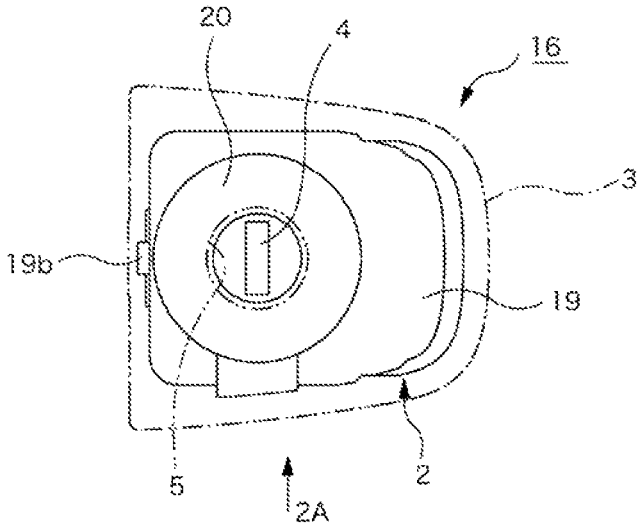
FIG. 1B is an enlarged view of a decorative cap member portion.

FIG. 1A shows an outside handle device of a vehicle. The outside handle device includes a handle base 14, which is fixed to a door panel 1 of the vehicle, an operation handle 15, which is connected to the handle base 14 in a manner of being freely rotatable around an axis of rotation (C), and a cylinder lock section 16, and a door opening operation of a door is possible as a result of a door latch (not illustrated in the drawings), which retains a door in a closed door state as a result of the operation handle 15 being operated in a rotating manner so that a free end section is drawn out from the door panel 1, being released.

Figure 2A:
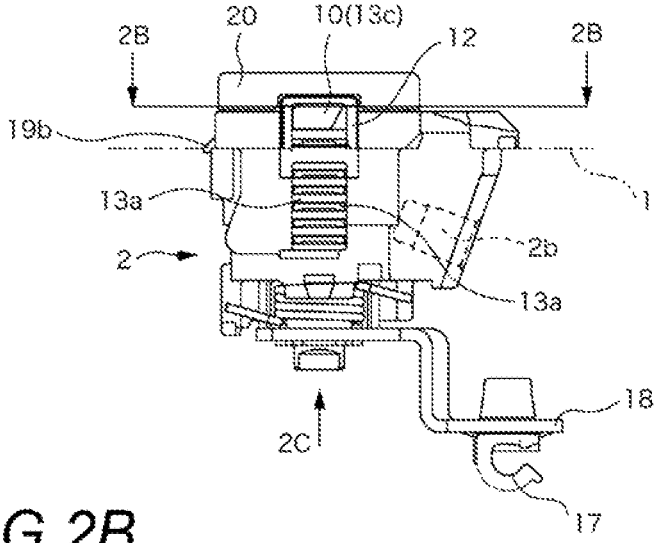
FIG. 2A is an arrow view in the direction of 2A in FIG. 1B.
Figure 2B:
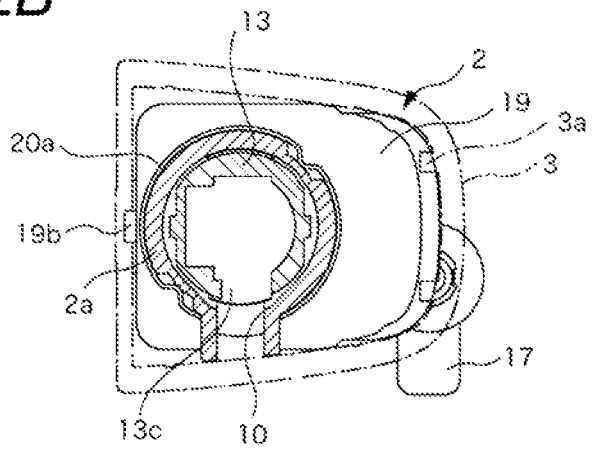
FIG. 2B is a cross-sectional view along a line 2B-2B in FIG. 2A.

As shown in the drawing, the cylinder lock section 16 is formed by mounting a decorative cap member 3 onto a cylinder lock 2. The cylinder lock 2 is formed by inserting a plug 13, to which an appropriate number of tumblers 13*a* are attached, inside a cylinder case 2*a* in a freely rotatable manner. The cylinder lock 2 is fixed to the handle base 14 using a screw, which is not illustrated in the drawings, and which is screwed into an attachment hole 2*b*, which is formed in the cylinder case 2*a* (refer to FIG. 2A).

A lever 18, onto which a rod bar connection holder 17 is mounted, is connected to a trailing end of the plug 13 of the cylinder lock 2. When the cylinder lock 2 is operated in a rotating manner using an unlocking key, which is inserted from a key insertion section 4, which is provided in the plug 13, in a fixed state to the door panel 1, it is possible to control the availability of an operation that uses the operation handle 15 of the door latch.

A protrusion portion from the door panel 1 of the cylinder lock 2 includes an attachment pedestal section 19, and a columnar protrusion portion 20 that accommodates a top portion of the plug 13. The infiltration of water inside the plug 13 from the key insertion section 4 is prevented as a result of the outer surface of the columnar protrusion portion 20 being covered by a metal cap 20*a*, and a shutter plate 13*b*, which is pressed onto the metal cap 20*a* using a biasing unit, which is not illustrated in the drawings, being mounted on a top portion of the plug 13.

In addition, a water removal hole 13*c* for ejecting water that is infiltrated inside the plug 13, is provided in the top portion of the plug 13. A water removal opening 10 for communicating with the water removal hole 13*c* of the plug 13, which is an initial rotational position, is provided on the cylinder case 2*a*.

Meanwhile, the decorative cap member 3 covers the protrusion portion from the door panel 1 of the cylinder lock 2, with a synthetic resin material injection molded product. The decorative cap member 3 is formed symmetrically for left-right use. In addition, the decorative cap member 3 is formed so that the entirety thereof has a substantially uniform thickness in order to prevent the generation of external appearance defects such as sink marks, and as a result, a gap(hereinafter, a "hollow portion") is formed between the decorative cap member 3 and the outer surface of the cylinder lock 2.

Figure 2C:
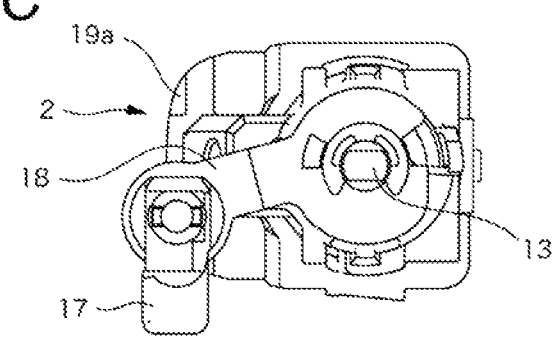
FIG. 2C is an arrow view in the direction of 2C in FIG. 2A.

The mounting of the decorative cap member 3 to the cylinder lock 2 is performed by engaging an engagement claw 3*a*, which protrudes inward from a peripheral wall, together with an engagement recessed section 19*a*, which is formed in the attachment pedestal section 19 of the cylinder lock 2 (refer to FIG. 2C), and snap engaging an engagement hole 3*c*, which is provided in an open manner in an elastic leg 3*b* that is disposed on an opposite edge, together with an engagement projection 19*b* of the attachment pedestal section 19. In addition, a positioning protruding portion 3*d*, which abuts against a surface of the attachment pedestal section 19 of the cylinder lock 2, is provided in the decorative cap member 3 in order to regulate a mounting position of the decorative cap member 3.

In addition, a key insertion opening 5 is provided in the decorative cap member 3 in a manner that surrounds the key insertion section 4 of the plug 13. A ring-shaped flat surface 21, which faces the columnar protrusion portion 20 of the cylinder lock 2 leaving a predetermined clearance (61), is formed on a peripheral edge of the key insertion opening 5 (refer to FIG. 3B and FIG. 4B). A slit-shaped water guide groove 8 (with a depth of δ2), is formed on the ring-shaped flat surface 21 in a manner that intersects the ring-shaped flat surface. A water guide wall 9 for guiding water that flows from the water guide groove 8, to a water ejection opening 6, which is provided in a side wall portion, is provided on a rear surface of a hollow portion of the decorative cap member 3.

Figure 3A:
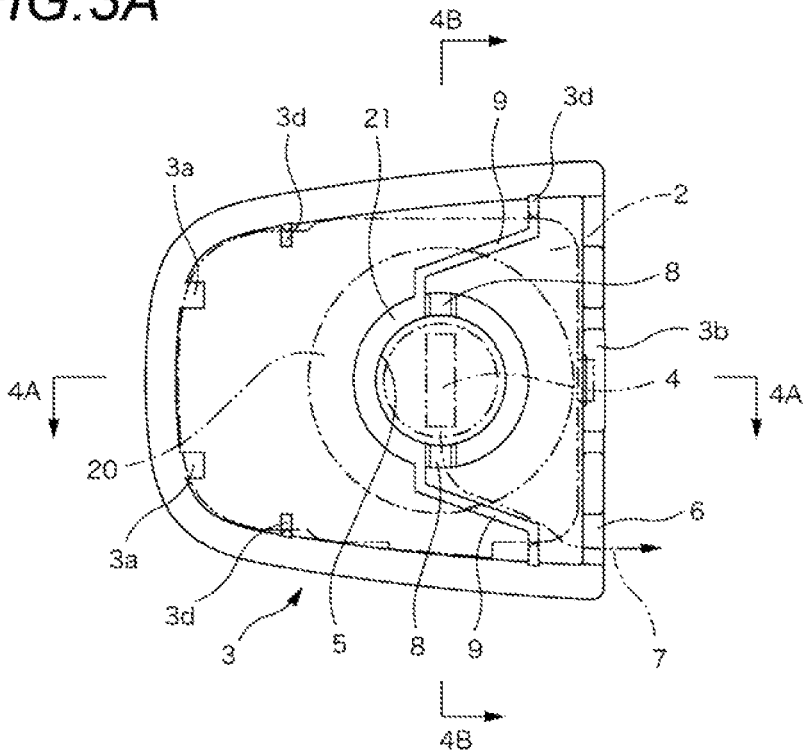
FIG. 3A is a rear surface view of a decorative cap member.
Figure 3B:
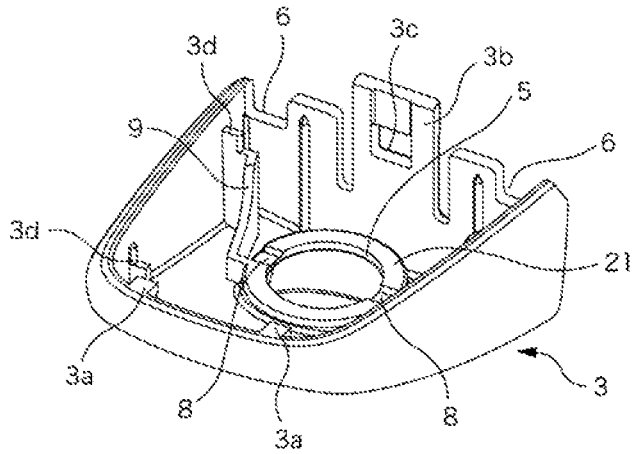
FIG. 3B is a perspective view of the decorative cap member viewed from a rear surface.

As shown in FIG. 3A, the water ejection opening 6 is formed in a manner that is not obstructed by the attachment pedestal section 19 of the cylinder lock 2 by cutting out a corner angle portion of the decorative cap member 3. The water guide wall 9 is formed in an inclined surface form in a manner that is disposed along a side wall portion of the columnar protrusion portion 20 of the cylinder lock 2.

Accordingly, in the present example, water that is retained at the peripheral edge of the key insertion opening 5, preferentially infiltrates into the hollow portion of the decorative cap member 3 from the water guide groove 8, and is ejected to the outside from the water ejection opening 6 as a result of passing through a water guide channel 7 defined by the water guide wall 9.

Figure 4A:
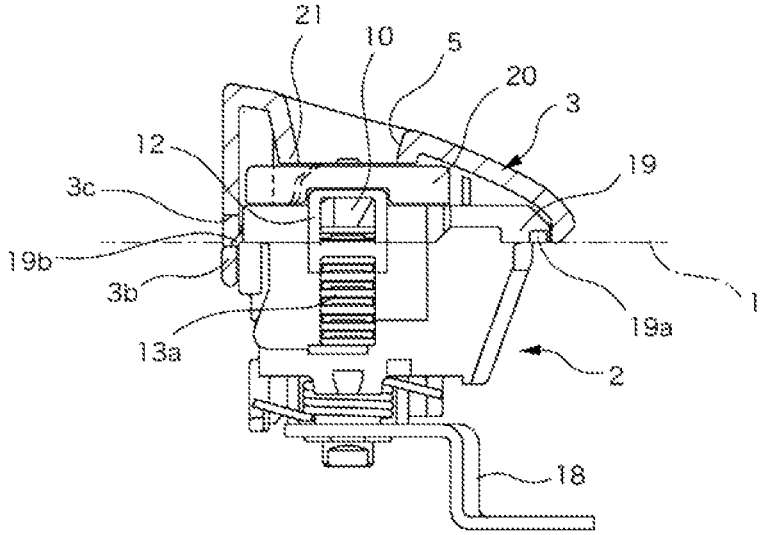
FIG. 4A is a cross-sectional view along a line 4A-4A in FIG. 3A.
Figure 4B:
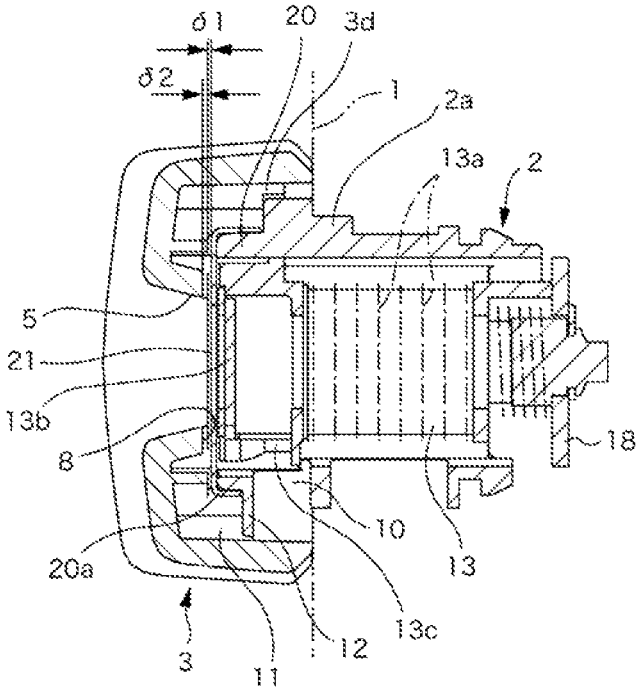
FIG. 4B is a cross-sectional view along a line 4B-4B in FIG. 3A.

As shown in FIGS. 4A and 4B, a water removal space 11 is provided between the periphery of the water removal opening 10 of the cylinder lock 2, and the decorative cap member 3 in order to avoid obstruction of the water removal opening 10 by the decorative cap member 3. A dividing wall 12 is provided in a protruding manner at the peripheral edge of the water removal opening 10 of the cylinder lock 2 in a manner that surrounds the water removal opening 10 with the exception of a back end portion thereof. As shown in FIG. 4B, the dividing wall 12 isolates the water removal opening 10 from the water removal space 11 by as a result of a tip end thereof abutting against an inner peripheral wall of the decorative cap member 3, and reverse flow to the water removal opening 10, and consequently, to the water removal hole 13*c* of the plug 13 of water that infiltrates into the hollow portion of the decorative cap member 3, is prevented.

According to the present disclosure, a mounting structure of a decorative cap includes a door panel 1, a cylinder lock 2 fixed to the door panel 1, and a decorative cap member 3. A protrusion portion of the cylinder lock 2 protruding from the door panel 1 is covered with the decorative cap member 3. The decorative cap member 3 includes a water guide channel 7 guiding infiltrated water from a gap between a key insertion opening 5 and a surface of the cylinder lock 2, to a water ejection opening 6 which is opened on a peripheral wall. The key insertion opening 5 exposes a key insertion portion 4 of the cylinder lock 2.

The decorative cap member 3 includes the key insertion opening 5 for making access to the cylinder lock 2 possible, and covers the protrusion portion from the door panel 1 of the cylinder lock 2 by connecting to the cylinder lock 2, which is fixed to the door panel 1 of a vehicle, or a retention member, which retains the cylinder lock 2 as appropriate.

Generally, a gap is generated between the key insertion opening 5 of the decorative cap member 3, which is formed and mounted separately to the cylinder lock 2, and the outer surface of the cylinder lock 2, and even in a case in which the corresponding gap is small, it is not possible to prevent infiltrated water in a high water pressure environment such as a car wash, and therefore, water that infiltrates from the gap is retained in the gap between the cylinder lock 2 and a decorative cap section, builds up, and there is a concern of reverse flow from the water removal opening 10, which is provided in the cylinder lock 2.

However, according to the mounting structure of a decorative cap of the present disclosure, since infiltrated 5 water from the key insertion opening 5 is quickly guided to the water ejection opening 6 via the water guide channel 7, the retention of infiltrated water inside the gap between the cylinder lock 2 and the decorative cap, is prevented, and therefore, reverse flow to the water removal opening 10 is 10 reliably prevented.

Generally, in a case in which the decorative cap member 3 is formed in a hollow shape as a result of a sufficient space being retained between the decorative cap member 3 and the cylinder lock 2, the hollow portion becomes a retention space of infiltrated water, and therefore, can potentially increase the water pressure during reverse flow. However, in the mounting structure of a decorative cap of the present disclosure, since it is possible to effectively prevent the retention of infiltrated water in the hollow portion, it is possible to reliably prevent the infiltration of water inside the cylinder lock 2 as a result of this cause.

Furthermore, in a case in which a water retention space is formed around the key insertion opening 5 for design reasons, or the like, generally, there is a possibility that infiltration of water will occur inside the plug 13 of the cylinder lock 2 from the retention space. However, in the mounting structure of the decorative cap of the present disclosure in which the decorative cap member 3 effectively prevents the retention of water inside a border portion with the cylinder lock 2, since water that is supplied to the retention space around the key insertion opening 5, is ejected from the water ejection opening 6 via the water guide channel 7, it is possible to effectively suppress the infiltration of water inside the plug 13 from the retention space.

In addition, according to the mounting structure of the decorative cap of the present disclosure, a water guide groove 8 may be formed on a peripheral edge rear surface of the key insertion opening 5 of the decorative cap member 3. The water guide groove 8 guides water that is retained at a peripheral edge of the key insertion opening 5.

The water guide groove 8 on the peripheral edge rear surface of the key insertion opening 5 has a flow path resistance that is smaller than a flow path resistance of other gaps around the key insertion opening 5. In order to guide infiltrated water to the water ejection opening 6 from the entire area of the key insertion opening 5, generally, it is necessary to set a multitude of water guide channels 7, but in the mounting structure of a decorative cap of the present disclosure, in which an infiltration port to the water guide channel 7 is limited, it is possible to efficiently guide infiltrated water to the water ejection openings 6, 6 using a small number of water guide channels 7,7, respectively defined by water guide walls 9,9.

Furthermore, according to the mounting structure of a decorative cap of the present disclosure, the water removal opening 10 and the water removal space 11 may be separated from each other by a dividing wall 12 protruding from a peripheral edge of the water removal opening 10 of the cylinder lock 2 and abutting against a wall surface of the decorative cap member 3.

It is necessary to perform crowning of the decorative cap member 3 in a manner that does not obstruct the water removal opening 10, which is provided on the cylinder lock 2, and the water removal space 11, which corresponds to a space for water ejection from the water removal opening 10, is ensured between the decorative cap member 3 and the cylinder lock 2.

According to the mounting structure of the decorative cap of the present disclosure, the reverse flow of infiltrated water to the water removal opening 10 from the space for water ejection is prevented by providing the dividing wall 12 at the peripheral edge of the water removal opening 10 and causing the dividing wall 12 to abut against the wall surface of the decorative cap member 3.

According to the mounting structure of a decorative cap of the present disclosure, it is possible to effectively prevent the infiltration of water inside a cylinder lock.

The present invention was described referring to detailed or specific embodiments, but it should be apparent to a person skilled in the art that various modifications and corrections can be applied without departing from the spirit and range of the invention.

REFERENCE SIGNS LIST

1 DOOR PANEL
2 CYLINDER LOCK
3 DECORATIVE CAP MEMBER
4 KEY INSERTION SECTION
5 KEY INSERTION OPENING
6 WATER EJECTION OPENING
7 WATER GUIDE CHANNEL
8 WATER GUIDE GROOVE
9 WATER GUIDE WALL
10 WATER REMOVAL OPENING
11 WATER REMOVAL SPACE
12 DIVIDING WALL

What is claimed is:

1. A mounting structure of a decorative cap comprising:
a door panel;
a cylinder lock fixed to the door panel; and
a decorative cap member;
wherein a protrusion portion of the cylinder lock protruding from the door panel is covered with the decorative cap member,
wherein the decorative cap member includes a water guide channel guiding infiltrated water from a gap between a key insertion opening of the decorative cap member and the cylinder lock, to a water ejection opening which is opened on a peripheral wall of the decorative cap member,
wherein the key insertion opening exposes a key insertion section of the cylinder lock,
wherein a water guide groove is formed on a peripheral edge rear surface of the key insertion opening of the decorative cap member, and
wherein the water guide groove guides water that is retained at a peripheral edge of the key insertion opening.

2. The mounting structure of the decorative cap according to claim 1,
wherein the water guide channel is defined by a water guide wall protruding from a rear surface of the decorative cap member which abuts against the surface of the cylinder lock.

3. The mounting structure of the decorative cap according to claim 2,
wherein the water guide channel is disposed bypassing a water removal opening which is opened in the protrusion portion of the cylinder lock.

4. The mounting structure of the decorative cap according to claim 1,
wherein a water removal opening and a water removal space formed by the decorative cap member are separated from each other by a dividing wall protruding at a peripheral edge of the water removal opening of the cylinder lock and abutting against an inner wall surface of the decorative cap member.

5. The mounting structure of the decorative cap according to claim 2,
wherein a water removal opening and a water removal space formed by the decorative cap member are separated from each other by a dividing wall protruding at a peripheral edge of the water removal opening of the cylinder lock and abutting against an inner wall surface of the decorative cap member.

6. A decorative cap that covers a part of a cylinder lock, the decorative cap comprising:
a key insertion opening configured to expose a key insertion section of the cylinder lock;
a water ejection opening which is opened on a peripheral wall of the decorative cap; and
a water guide channel configured to guide infiltrated water from a gap between the key insertion opening and the cylinder lock,
wherein a water guide groove is formed on a peripheral edge rear surface of the key insertion opening, and
wherein the water guide groove guides water that is retained at a peripheral edge of the key insertion opening.

7. The decorative cap according to claim 6,
wherein the water guide channel is defined by a water guide wall protruding from a rear surface of the decorative cap which abuts against the cylinder lock.

8. The decorative cap according to claim 7,
wherein the water guide channel is configured to be disposed bypassing a water removal opening which is opened in a protrusion portion of the cylinder lock.

9. The decorative cap according to claim 8.
wherein the water removal opening and a water removal space formed by the decorative cap are separated from each other by a dividing wall protruding at a peripheral edge of the water removal opening of the cylinder lock and abutting against an inner wall surface of the decorative cap.

10. The decorative cap according to claim 7,
wherein a water removal opening and a water removal space formed by the decorative cap are separated from each other by a dividing wall protruding at a peripheral edge of the water removal opening of the cylinder lock and abutting against an inner wall surface of the decorative cap.

* * * * *